US007942485B2

(12) United States Patent
Castelluccio

(10) Patent No.: US 7,942,485 B2
(45) Date of Patent: May 17, 2011

(54) DEPLOYABLE WORKSTATION

(76) Inventor: Kathi Castelluccio, West Chicago, IL (US)

( * ) Notice: Subject to any disclaimer, the term of this patent is extended or adjusted under 35 U.S.C. 154(b) by 386 days.

(21) Appl. No.: 12/152,549

(22) Filed: May 15, 2008

(65) Prior Publication Data

US 2008/0284292 A1 Nov. 20, 2008

Related U.S. Application Data

(60) Provisional application No. 60/930,319, filed on May 15, 2007.

(51) Int. Cl.
*A47B 83/00* (2006.01)

(52) U.S. Cl. ..... 312/235.3; 312/195; 312/235.2

(58) Field of Classification Search ..... 108/25, 108/26; 312/195, 196, 107, 108, 330.1, 283, 312/235.2, 235.3, 292
See application file for complete search history.

(56) References Cited

U.S. PATENT DOCUMENTS

| | | | | | |
|---|---|---|---|---|---|
| 187,429 | A | * | 2/1877 | Sykes | 312/235.3 |
| 1,779,327 | A | * | 10/1930 | Moss | 232/43.2 |
| 2,103,552 | A | * | 12/1937 | Alexander | 312/235.3 |
| 3,570,418 | A | | 3/1971 | Gooding | |
| 3,841,727 | A | | 10/1974 | Peng | |
| 3,874,729 | A | | 4/1975 | Blodee | |
| 3,982,784 | A | | 9/1976 | Esser | |
| 4,030,846 | A | | 6/1977 | Flototto | |
| 4,163,592 | A | | 8/1979 | Nelson | |
| 4,296,574 | A | | 10/1981 | Stephens | |
| 4,418,967 | A | | 12/1983 | Winkelman, Jr. et al. | |
| 4,462,126 | A | | 7/1984 | Cleaveland | |
| 4,563,040 | A | | 1/1986 | Alster | |
| 4,722,473 | A | | 2/1988 | Sandrini et al. | |
| 4,940,149 | A | | 7/1990 | Vineis | |
| 4,988,145 | A | | 1/1991 | Engel | |
| 4,995,668 | A | | 2/1991 | Zivari | |
| 5,014,861 | A | | 5/1991 | Stadtler | |
| 5,094,417 | A | | 3/1992 | Creed | |
| 5,125,202 | A | | 6/1992 | Kissinger | |
| 5,160,188 | A | | 11/1992 | Rorke et al. | |
| 5,160,517 | A | | 11/1992 | Hicks et al. | |
| 5,161,760 | A | | 11/1992 | Terbrack | |
| 5,175,672 | A | | 12/1992 | Conner et al. | |
| 5,226,705 | A | | 7/1993 | Rorke et al. | |
| 5,328,260 | A | | 7/1994 | Beirise | |
| 5,423,597 | A | | 6/1995 | Rogers | |
| 5,452,554 | A | | 9/1995 | Santana | |
| 5,454,581 | A | | 10/1995 | Ringer | |
| 5,511,851 | A | | 4/1996 | Zivari | |
| 5,577,818 | A | | 11/1996 | Sayre | |

(Continued)

*Primary Examiner* — Janet M Wilkens
*Assistant Examiner* — Dan Rohrhoff
(74) *Attorney, Agent, or Firm* — Joseph A. Fuchs; Rockey, Depke & Lyons, LLC

(57) ABSTRACT

A desk unit assembly deployable from a closed position to an open position. The desk unit assembly has a desk portion and a chair assembly. The desk portion has a top, two opposed and vertically extending sidewalls, a rear wall and a front wall, the top, sidewalls, front and rear walls define a chamber therebetween. A chair assembly has a seat and a backrest, the seat is disposed within the chamber and the backrest forms a portion of the front wall of the desk portion when the desk unit assembly is in the closed position. The assembly has a generally cubical shape with substantially flat outer surfaces of the two sidewalls, the front wall and the rear wall when in the closed position and when the assembly is in the open position the chamber can accommodate the legs of a user.

12 Claims, 3 Drawing Sheets

U.S. PATENT DOCUMENTS 5,754,995 A 5/1998 Behrendt
5,765,239 A 6/1998 Moses
5,784,843 A 7/1998 Greer et al.
5,809,708 A 9/1998 Greer et al.
5,873,205 A 2/1999 Hanlon et al.
5,927,835 A * 7/1999 Mergold et al. ..... 312/235.3
5,967,600 A 10/1999 Jelacic et al.
5,983,420 A 11/1999 Tilley
5,993,216 A 11/1999 Stogner
6,048,127 A 4/2000 Kern et al.
6,067,762 A 5/2000 Greer et al.
6,068,331 A * 5/2000 Barnes ..... 297/140
6,086,172 A 7/2000 Lee
6,126,253 A * 10/2000 Kelley et al. ..... 312/195
6,128,873 A 10/2000 Shipman et al.
6,276,102 B1 8/2001 Shipman et al.
6,302,037 B1 10/2001 Del Frari
6,303,388 B1 10/2001 Fahy
6,367,874 B2 4/2002 Casini
6,378,255 B1 4/2002 Eich et al.
6,390,559 B1 5/2002 Schnitzhofer
6,675,408 B1 1/2004 Mason
6,836,912 B1 1/2005 Morris
6,877,824 B2 4/2005 Winkless
6,945,785 B2 * 9/2005 Sohl et al. ..... 434/408
6,969,119 B1 11/2005 Jennings
6,976,732 B2 12/2005 Thomas et al.
7,014,267 B1 3/2006 Nagar
7,198,325 B2 4/2007 Dewert
7,261,384 B1 * 8/2007 Craft et al. ..... 312/235.3
2002/0014792 A1 2/2002 Casini
2003/0151336 A1 8/2003 Freeman
2003/0218365 A1 11/2003 Kawiaka
2004/0026998 A1 2/2004 Henriott et al.
2004/0164653 A1 8/2004 Winkless
2004/0217677 A1 11/2004 Durand et al.
2005/0017565 A1 1/2005 Sprouse
2005/0104491 A1 * 5/2005 Zenda et al. ..... 312/330.1
2005/0179235 A1 8/2005 Stewart et al.
2005/0200250 A1 9/2005 Zillmann et al.
2005/0202393 A1 9/2005 Morgan et al.
2005/0253424 A1 11/2005 Thomas et al.
2005/0279257 A1 12/2005 Bettinger
2006/0000790 A1 1/2006 Smiddy et al.
2006/0033713 A1 2/2006 Pryor
2006/0097608 A1 5/2006 Dugand
2006/0150530 A1 7/2006 Davey
2006/0238085 A1 10/2006 Greenberg
2006/0254471 A1 11/2006 Luchetti et al.
2006/0254479 A1 11/2006 Luchetti et al.
2006/0283098 A1 12/2006 Golino et al.
2007/0039150 A1 2/2007 Thomas et al.
2007/0040084 A1 2/2007 Sturman et al.

* cited by examiner

FIG. 2
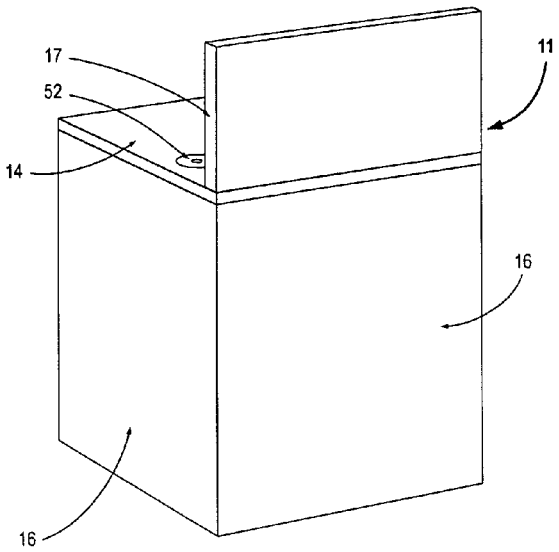
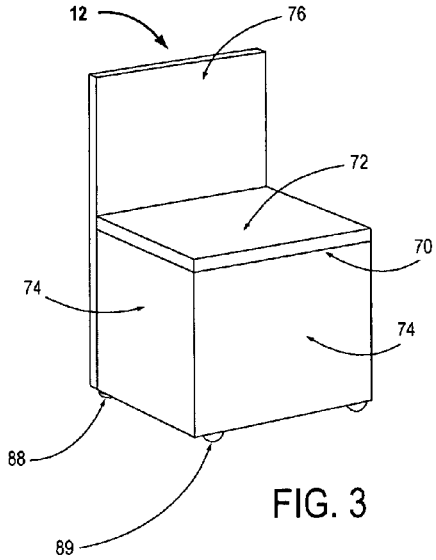
FIG. 3
FIG. 4
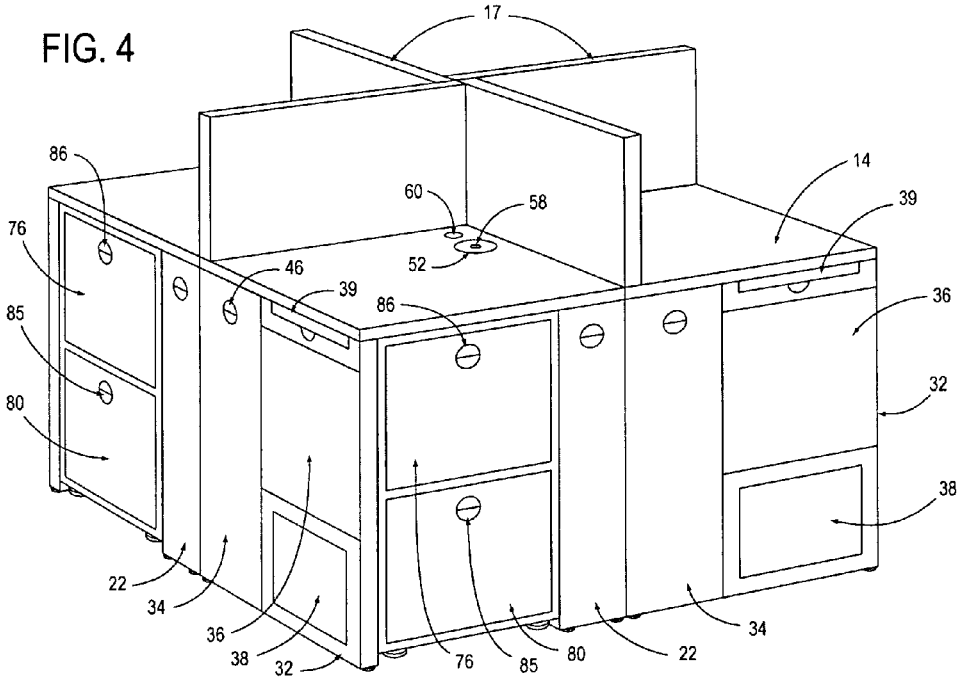

DEPLOYABLE WORKSTATION

RELATED APPLICATION

The present patent application claims priority to U.S. Provisional Patent Application No. 60/930,319, filed on May 15, 2007, the disclosure of which is incorporated in its entirety herein by reference and made a part hereof.

BACKGROUND OF THE INVENTION

1. Technical Field

The present invention is generally related to furniture and more specifically to a furniture system that can be deployed from a stowed, space-saving, closed position to an extended, open position to form a workstation.

2. Background Art

Modular furniture generally refers to furniture that is assembled from a number of basic modules that, in combination, provide the functionality required. The basic modules can be configured by a user to provide a number of configurations. Each configuration can vary in terms of size, utility, design, color, etc. The finished product is typically permanently fastened together in the desired configuration and deployed. More recently, a number of modular furniture solutions have appeared on the market wherein the modules can be configured to suit a number of requirements and are generally not fastened together with any permanency. The modules are generally box-like, having four lateral walls, a bottom and a top. The top typically has a set of features that correspond to a set of complementary indentations in the bottom. Modular furniture typically cannot be moved from a space-savings position to a deployed position to form a workstation.

These and other aspects and attributes of the present invention will be discussed with reference to the following drawings and accompanying specification

BRIEF DESCRIPTION OF THE DRAWINGS

FIG. 2 is a perspective view showing the back and right side of the desk part of the article of furniture;

FIG. 3 is a perspective view showing the chair part of the article of furniture;

FIG. 4 is a view showing four units of the article of furniture grouped together;

DETAILED DESCRIPTION OF THE INVENTION

Figure 1:
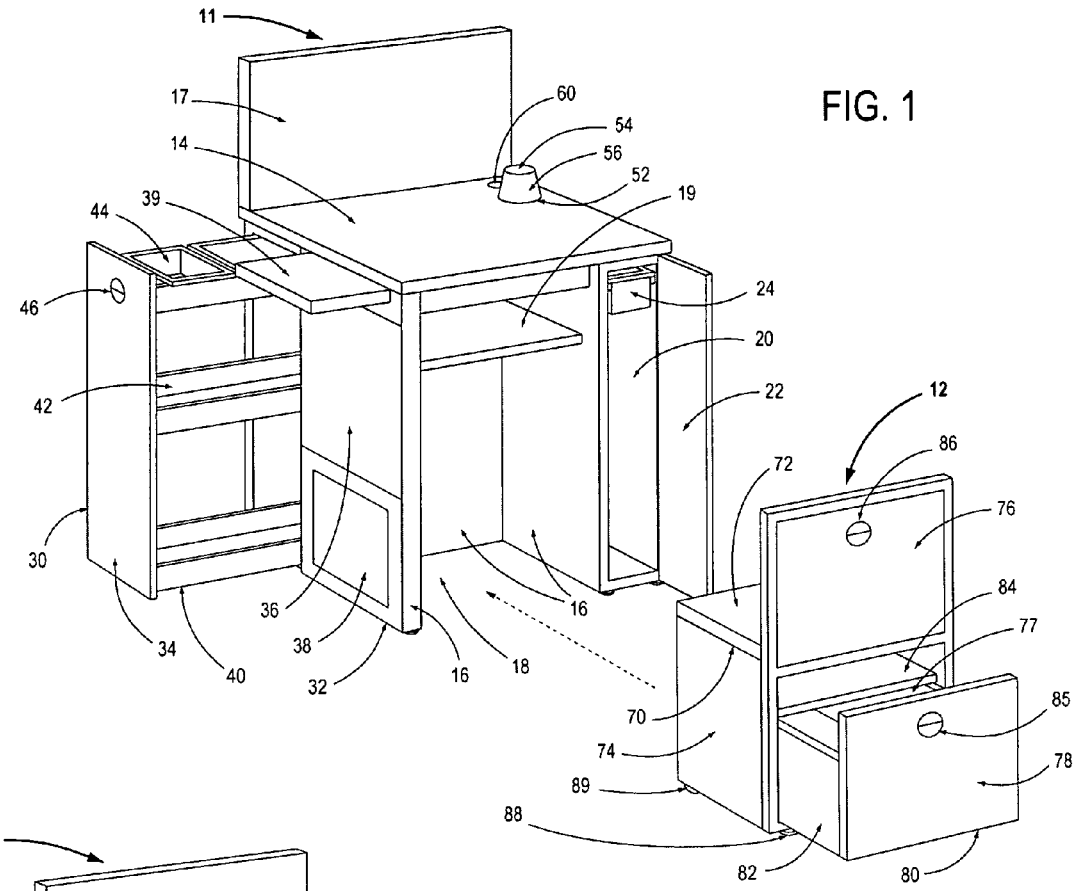
FIG. 1 is a perspective view showing an article of furniture in accordance with the present invention in an extended or deployed position.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

Figure 1A:
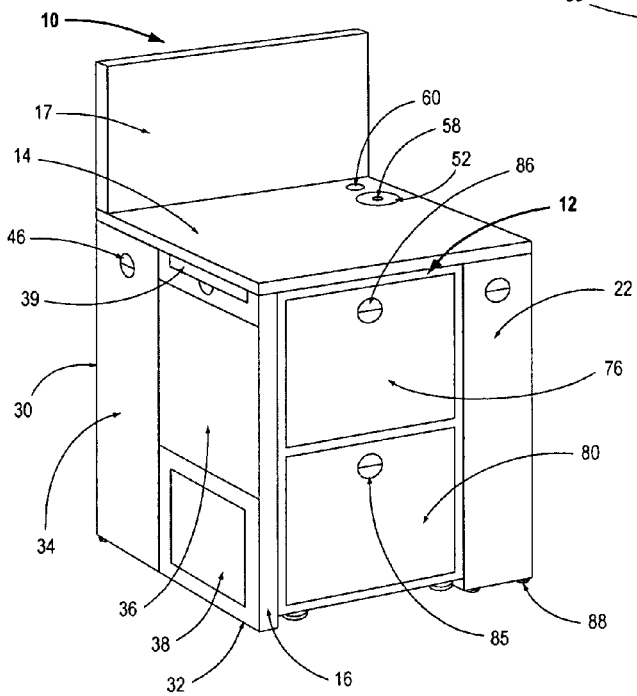
FIG. 1A is a view corresponding to the view of FIG. 1 but showing the inventive article of furniture in a closed, space-savings position.

FIG. 1 shows a deployable desk unit assembly 10 having a desk unit 11 and a chair unit 12 in a fully-deployed position and FIG. 1A shows the desk unit assembly 10 in a fully-closed or space-savings position. When in the closed position the desk unit assembly 10 has a generally cubical shape with each of the vertical walls having a substantially flat or flush outer surface. It can be appreciated the significant space-savings that can be achieved by moving the desk unit assembly 10 from an open position to a closed position. Likewise, it can be appreciated of the substantial increase in the surface area for working on and sitting on that is achieved by moving the desk unit 10 from a closed position to an open position. The deployable desk unit assembly 10 can be moved between open and closed position without the use of tools.

The desk unit 11 has a generally square or rectangular top 14, four vertical walls 16 which are generally square or rectangular in shape, and a generally rectangular shaped privacy panel 17 extending vertically from one of the vertical walls. The top 14 and the vertical walls 16 define a centrally disposed chamber 18 which is dimensioned to receive the chair unit 12 when the desk assembly 10 is in the closed position and the legs of a person seated at the desk when in the deployed position. A shelf 19 or drawer can be provided in the chamber 18 so long as they do not provide an impediment to the chamber 18 receiving the chair unit 12. The desk unit further has a first storage cabinet 20 accessible through a hinged door 22 on a front face of the desk unit 11 adjacent the chamber 18. The door 22 can have an optional latching mechanism to releasably retain the door when it is in the closed position. The storage cabinet 20 can accommodate shelves or drawers for the storage of supplies, and in one preferred form of the invention, the storage cabinet 20 has a pull-out drawer 24 for the storage of supplies such as pens and pencils.

The desk unit 11 further has a first lateral surface 30 having a first panel 32 and a second panel 34. The first panel 32 has a first area 36 and a second area 38 in vertical spaced relationship. The first area 36, in a preferred form of the invention, is a dry erase board, and even more preferably a magnetic, dry erase board. The second area 38 provides an artwork display frame and more preferably a magnetic, artwork display frame. The first panel 32, in the first area 36, has a portion removed to accommodate a slide-out bread board 39 to serve as a writing surface or a work surface. The bread board 39 is mounted to the desk for reciprocating, sliding movement from a stowed position (FIG. 1A) to an open position (FIG. 1). A finger hole is provided either above or below the board to allow a user the grab the board to pull it from the stowed position. Suitable hardware, not shown, can be provided to ease the sliding movement of the bread board 39 with respect to the desk unit 11.

The second panel 34 of the first lateral surface 30 forms an end wall of a pull-out storage unit 40. In a preferred form of the invention the second panel 34 extends substantially the entire height of the assembly 10 from a position just below a bottom surface of the desk top 14 to a lower peripheral edge that is in line with a lower peripheral edge of panel 32. The pull out storage unit 40 is moveable from a closed position (FIG. 1A) where it is stowed within the chamber 18, and is flush with the first panel 32, to an open position (FIG. 1) where it extends laterally outward from the first panel 32. In one preferred form of the invention, the storage unit 40 has a length essentially of equal dimension to a length of the chamber 18 to maximize the storage space of the storage unit 40. It is contemplated the storage unit can be mounted on a track or on multiple tracks, that are attached to the desk or the storage unit, to provide ease of movement of the storage unit 40. It is contemplated the storage unit or the desk could be fitted with a track engaging mechanism such as a set of wheels that roll along the track. Other mechanisms could also be used to ease the movement of the storage unit 40 and are well known in the art and particularly to those who are skilled in the art of manufacturing or installing sliding drawers.

In a preferred form of the invention, the pull out storage unit 40 will have shelves 42, three are shown, one of which is shown supporting removable storage bins 44. A finger-accessible finger pull 46 can be provided to assist a user in sliding the storage unit 40 from the stowed position to the open position. The storage unit 40 can be independently moved regardless of whether the seat unit 12 is in a stowed or open position. When the storage unit 40 is open and the chair unit 12 is stowed the assembly 10 is in a partially deployed position.

The desk top 14 also has a cup holder 50 and a cup 52 having complementary shapes for use and stowage of the cup. The cup 52 has a mouth 54 at one end and an outer wall, a portion of which tapers 56 radially outwardly from the mouth 54 to a bottom portion of the cup to define a truncated conical shaped cup having its largest diameter at the bottom of the cup (cup diameter). The cup holder 50 has an opening into the desk top 14 defining an annular wall that tapers axially inwardly from the top of the desk to a bottom of the annular wall. The annular wall has a first diameter at the top of the desk top and a second diameter at a bottom of the annular wall. The first diameter is larger than the cup diameter but the second diameter is smaller than the cup diameter. When in the use position shown in FIG. 1, the bottom portion of the cup extends through the opening in the desk and the bottom portion of the cup forms an interference fit with the annular wall. The cup is releasably secured in this use position to resist inadvertent tipping of the cup and/or spillage of the cup's contents onto the desk top. When the cup is in the stowed position shown in FIG. 1A, a top portion of the cup extends through the desk top to a point where the bottom portion of the cup forms an interference fit with the annular wall. In a preferred form of the invention, a bottom surface of the cup will be essentially flush with a top surface of the desk top. Also, in a preferred form of the invention, the cup will have a finger hold 58, or other member, to assist a user in removing the cup from its stowed position.

The desk top also provides a grommet 60 which extends through the top surface of the desk unit to allow for the passage of power cords and the like.

The chair unit 12 has a horizontally extending seat 70 with an optional seat cushion 72; a top surface of the seat cushion can extend below, be flush with or extend above the surrounding top surface of the seat. The chair 12 also has four vertically extending walls 74 and a vertically extending back rest 76 extending from one of the vertically extending walls. The four vertically extending walls 74 and the seat 70 together form a storage area 77 that is accessible by moving a slidable drawer 78. The drawer 78 can be mounted for reciprocating movement from a stowed position to an open position using hardware well known in the art. The drawer 78 has a front panel 80 and sidewalls 82 and a rear wall, not shown. Within the storage area 77 is a shelf 84. Finger pulls 85 and 86 are provided, respectively, for sliding the drawer 78 and the chair unit 12. In a preferred form of the invention, the chair unit 12 also has a pair of ground engaging leveling glides 88 on a leading edge of the chair unit 12 and a pair of casters 89 on a trailing edge of the chair unit 12. It is contemplated the positions of the leveling glides 88 and the casters 89 could be reversed in their relative positions and still be effective for their intended purpose.

The chair unit 12 is dimensioned such that when it is in the stowed position (FIG. 1A), the back rest 76 and the front panel of the drawer 80 will be flush with an outer surface of the door 22.

FIG. 4 shows four desk units 11 pushed together to abut one another to form a multi-user work station. The multi-user work station is ideal for use in home or school settings where space is at a premium. The desk units 11 can be attached to one another or merely abutted against one another whichever is more convenient or more suitable for the use of the multi-user work station.

Figure 5:
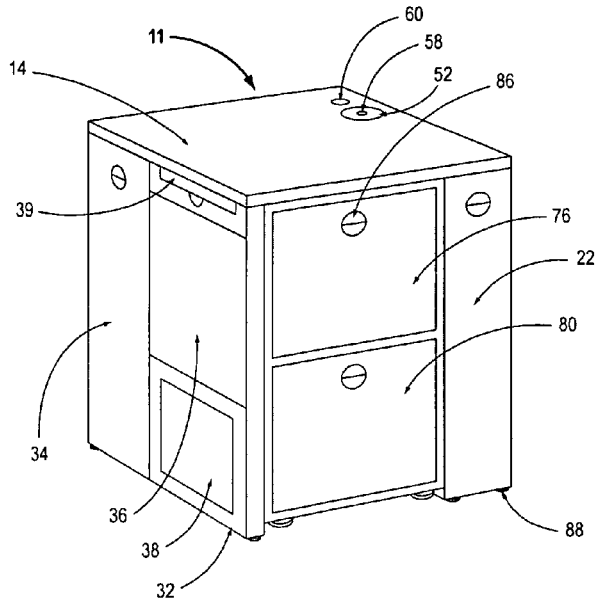
FIG. 5 is a view showing the article of furniture without an optional privacy screen.
Figure 6:
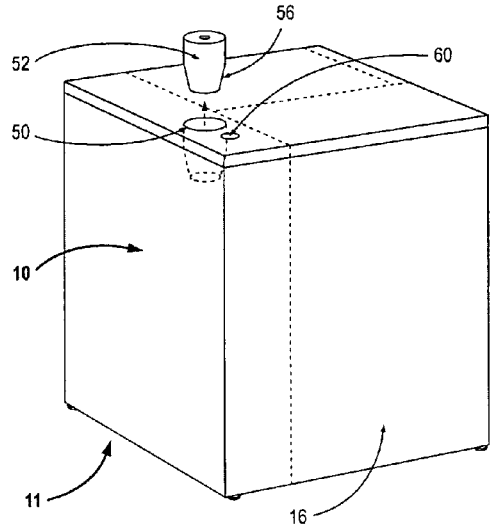
FIG. 6 is a view showing the back and right side of the desk part of the article of furniture without the optional privacy screen.
Figure 7:
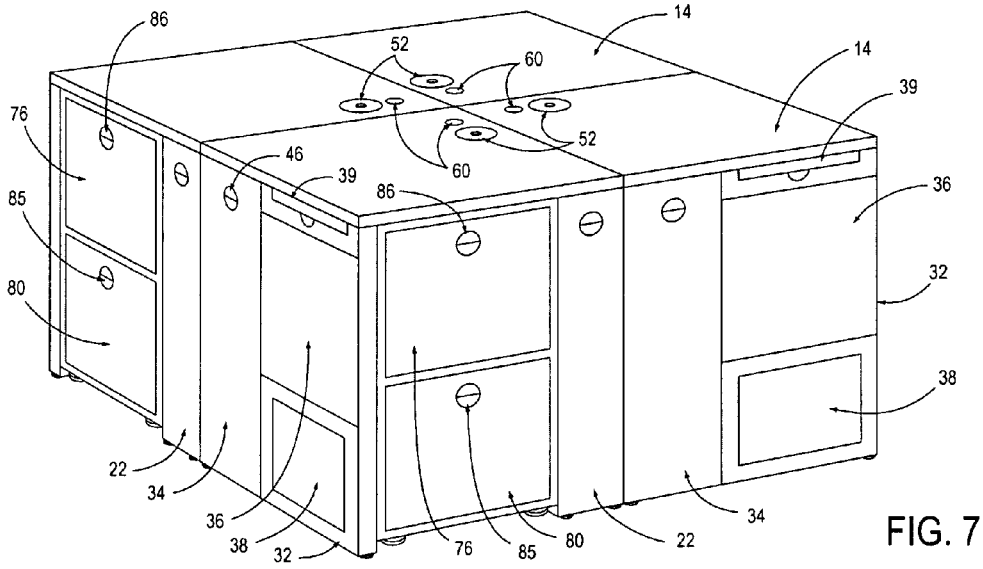
FIG. 7 is a view showing a grouping of four units of the article of furniture without the optional privacy screens.

FIGS. 5-7 show an alternative embodiment of the present invention having a desk unit 11 that does not have a privacy panel 17. All other aspects of the alternative embodiment is the same as discussed above with respect to FIGS. 1-4 and like numbers will be used to refer to like parts.

The desk unit 10 can be fabricated from any suitable material such as metal, plastic, wood, paperboard or composite materials. In a preferred form of the invention the privacy panel 17 and the dry erase board 36 will be made of a paramagnetic material to allow for attaching magnetic items thereto. The privacy panel, in another form of the invention, could include a cork material for attaching items using a thumb tack.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims

What is claimed is:

1. A desk unit assembly deployable from a closed position to an open position comprising:

a desk portion having a top wall, two opposed and vertically extending sidewalls, a rear wall and a front wall, the top, sidewalls, front and rear walls define a chamber therebetween, the top wall having a through hole to define a cup holder;

a chair assembly having a seat and a backrest, the seat disposed within the chamber and the backrest forming a portion of the front wall of the desk portion when the desk unit assembly is in the closed position;

a storage unit mounted for reciprocal translation movement from a first position where the storage unit is positioned within the chamber to a second open position where the storage unit extends laterally from one of the two opposed sidewalls and in a direction generally perpendicular to an outer surface of the one of the two opposed sidewalls from which the storage unit extends, the storage unit has a length substantially equal to a length of the chamber;

a storage compartment adjacent but separate from the chamber and having a hinged door to provide access to the storage compartment, the hinged door having an outer surface that is substantially flush with the backrest when the assembly is in the closed position;

a drinking cup having a base at one end and a mouth at the opposite end with an outer wall connecting the base to the mouth, the outer wall having a portion that tapers radially outwardly from the mouth to the base to define a truncated conical-shaped cup where the base has the largest diameter of the cup, the cup being moveable by a user of the cup from a stowed position where the mouth extends downwardly through the through hole into the chamber and the base forms an interference fit with a portion of the cup holder to define a surface flush with a surface of the desk top to a use position where the mouth of the cup faces upwardly away from the top wall and the base forms an interference fit with the cup holder; and the assembly having a generally cubical shape with substantially flat outer surfaces of the two sidewalls, the front wall and the rear wall and the top wall forming the uppermost horizontal surface of the assembly in both the open position and the closed position and when the assembly is in the open position the chamber can accommodate the legs of a user.

2. The assembly of claim 1 wherein a pull-out drawer is positioned within the storage compartment.

3. The assembly of claim 1 wherein the storage unit has a first outer panel, the outer panel extends vertically substantially the entire height of the desk unit and defines a portion of one of the two opposed sidewalls.

4. The assembly of claim 3 wherein the storage unit has a length substantially equal to a length of the chamber.

5. The assembly of claim 3 further comprising a second vertically extending outer panel extending parallel to the first outer panel, the second outer panel comprising a dry erase board.

6. The assembly of claim 5 further comprising a display frame on the second outer panel.

7. The assembly of claim 5 further comprising a bread board mounted for reciprocal translation movement from a stowed position where the bread board is positioned within the chamber to an open position where the bread board extends outward from the second outer panel.

8. The assembly of claim 7 further comprising a finger hole through the second outer panel proximate the bread board to allow a user to access a surface of the bread board when in the stowed position.

9. The assembly of claim 1 further comprising a privacy panel extending vertically upward from the rear wall above the desk top surface.

10. The assembly of claim 1 wherein the base of the cup has a member for assisting a user to move the cup from the stowed position to the use position.

11. The assembly of claim 1 wherein the chair unit has a plurality of vertically extending walls defining a chair chamber, a drawer is positioned within the chair chamber and is mounted for reciprocal translational movement from a stowed position to an open position, when in the stowed position an outer panel of the drawer is substantially flush with the back rest to define one of the plurality of vertically extending walls.

12. The assembly of claim 11 wherein the chair unit has ground engaging members to facilitate the sliding of the chair unit with respect to the desk portion.

* * * * *